United States Patent [19]

Suzuki et al.

[11] 4,097,140

[45] Jun. 27, 1978

[54] METHOD AND APPARATUS FOR CLEANING TONER IN ELECTROPHOTOGRAPHIC COPYING MACHINES

[75] Inventors: Kohji Suzuki, Kawasaki; Kazuaki Tagawa, Tokyo, both of Japan

[73] Assignee: Ricoh Company, Ltd., Tokyo, Japan

[21] Appl. No.: 707,615

[22] Filed: Jul. 22, 1976

[30] Foreign Application Priority Data

Jul. 22, 1975 Japan ..... 50-89501

[51] Int. Cl.[2] ..... G03G 21/00

[52] U.S. Cl. ..... 355/15; 118/652

[58] Field of Search ..... 15/1.5 R, 256.51, 256.52; 335/15; 118/652, 657

[56] References Cited

U.S. PATENT DOCUMENTS 3,580,673 5/1971 Yang ..... 355/15

3,950,089 4/1976 Fraser et al. ..... 355/15 X 4,006,987 2/1977 Tomono et al. ..... 355/15

OTHER PUBLICATIONS

Roller et al., "Brush Cleaner with Electrostatic Precipitator", IBM TDB, vol. 15, No. 12, May 1973, p. 3643.

*Primary Examiner*—A. D. Pellinen

*Attorney, Agent, or Firm*—Copper, Dunham, Clark, Griffin & Moran

[57] ABSTRACT

A method and apparatus for cleaning toner attaching to the surface of a photosensitive member of an electrophotographic copying machine of the dry, transfer type which employs a magnetic toner as developer. Subsequent to the transfer step, the magnetic toner which attaches to the surface of the photosensitive member is removed therefrom by a cylindrical brush, then transferred to a non-magnetic sleeve which internally houses a magnet, and finally scraped therefrom by a separator to fall down into a tray.

8 Claims, 3 Drawing Figures

METHOD AND APPARATUS FOR CLEANING TONER IN ELECTROPHOTOGRAPHIC COPYING MACHINES

BACKGROUND OF THE INVENTION

The invention relates to a method of and apparatus for cleaning toner which attaches to the photosensitive member of an electrophotographic copying machine of the dry, transfer type in which a magnetic toner is used as developer.

As used herein, the term "an electrophotographic copying machine of the dry, transfer type" refers to one involving an electrophotographic process which includes the steps of developing an electrostatic latent image formed on a photosensitive member, with a powder material commonly referred to as toner which can be electrostatically attracted, and transferring the developed powder image onto a copy sheet such as a usual paper, for example. In the machines of this type, it is necessary to provide some means to remove any residual toner from the surface of the photosensitive member subsequent to the transfer step. In many copying machines which are presently in use, the removal of such residual toner takes place by the use of a brush cleaning device which incorporates a cylindrical brush, as is described, for example, in U.S. Pat. Nos. 2,751,616 and 3,062,109. Where such a cleaning device is used, there must be provided a vacuum suction means for recovering the toner from the brush. However, the suction means generate undesirable noises and also requires a large space for its provision. As will be readily appreciated, it is highly desirable to provide a copying machine of a compact size and which is free from noises.

Recently a copying machine has been developed which employs a magnetic toner as the developing powder, as illustrated in U.S. Pat. No. 3,639,245. This toner is in the form of finely divided magnetic powder having a certain degree of electrical conductivity and comprising carbon and iron powder which are bonded together by a resin. The use of such magnetic toner facilitates the handling of the developer in the copying machine and achieves the developing result which is comparable to that of the usual developer.

SUMMARY OF THE INVENTION

A method of and apparatus for cleaning the magnetic toner in a copying machine in accordance with the present invention does include the described cylindrical brush, but does not include vacuum suction means. Magnetic toner attaching to the surface of the photosensitive member is removed therefrom by the brush, and then transferred onto a non-magnetic sleeve which internally houses a magnet, and finally scraped therefrom by a separator to fall down into a tray.

It is accordingly an object of the invention to provide a method of and an apparatus for cleaning an electrophotographic copying machine of the type which employs magnetic toner as a developer, while using a cylindrical brush but avoiding the use of vacuum suction means.

It is another object of the invention to provide a method of and an apparatus for removing magnetic toner from the cylindrical brush by magnetic attraction rather than suction applied by the vacuum.

With the present invention, the provision of vacuum suction means for recovering toner from the brush is avoided, thereby preventing the occurrence of undesirable noises and reducing the space requirement. Also the scattering or fatigue of the recovered toner is minimized, enabling the recovered toner to be recirculated into the developing system for reuse. Since it is only required of the brush to wipe off the toner which attached to the surface of the photosensitive member, there is no necessity to rotate the brush at a higher speed, so that the brush may be rotated at a low rate which is sufficient to peermit the clean area of the brush to be successively brought into engagement with the surface of the photosensitive member.

Further details of the invention will become apparent as the description proceeds with reference to the drawings.

DETAILED DESCRIPTION OF THE INVENTION

Figure 1:
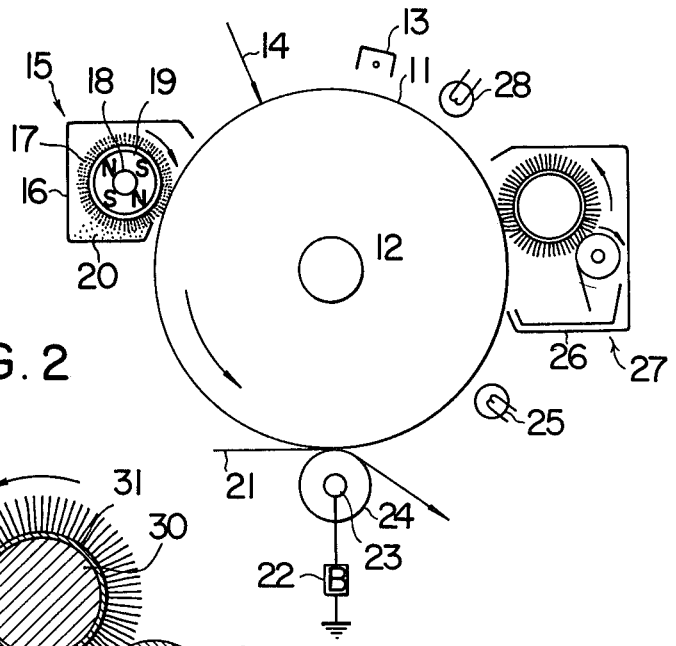
FIG. 1 is a schematic view of an electrophotographic copying machine to which the invention is applied.

Referring to FIG. 1, there is shown a photosensitive member in the form of a drum 11 having a photosensitive, insulating layer on its surface and which is mounted on a shaft 12 for rotation in the direction indicated by an arrow, at a uniform rate. Initially, the drum surface is uniformly charged by a primary charger formed by a corona discharger 13, and then it is imagewise exposed through an exposure optical system 14, whereupon the charge on the drum surface is selectively removed in accordance with the image of an original being copied to form an electrostatic latent image, which is subsequently converted into a visual image by a developing unit 15.

The developing unit 15 includes a housing 16 in which are fixedly mounted a non-magnetic sleeve 17, a magnet 19 contained within the sleeve 17 and mounted on a shaft 18 for rotation, and a quantity of magnetic toner 20 which is contained in the housing and attracted onto the sleeve 18 by the magnetic attraction of the magnet 19. When the magnetic toner 20 is attracted onto the sleeve 17, it forms a tuft which is commonly referred to as a magnetic brush, which moves in the opposite direction on the sleeve 17 from the direction of rotation of the magnet 19 into contact with the latent image, thus developing it. More specifically, the static electricity which forms the latent image produces an electrostatic induction, causing an electric charge of opposite polarity to that of the image charge to appear in the region of the magnetic toner which is located nearer the photosensitive drum. This produces an attraction of the magnetic toner onto the latent image. In order to accomplish the developing step, the electrostatic attraction acting on the magnetic toner must be greater in magnitude than the attraction exerted upon the magnetic toner by the magnet 19.

A developed toner image is subsequently moved into alignment with a transfer sheet 21, fed from a paper feeder, not shown, and is transferred onto the transfer sheet 21 by the action of a transfer roller 24 which is electrically connected with a bias source 22 and which is mounted on a shaft 23 for rotation, the roller also producing an electrostatic induction to attract the toner image as before. It will be understood that the bias potential applied to the roller must be of a magnitude which overcomes the electrostatic attraction acting between the drum 11 and the magnetic toner. After the toner image is transferred onto the transfer sheet 21, it is fixed by a fixing unit, not shown.

As is known, a certain amount of toner usually remains on the drum surface after the transfer step. To remove it, the drum is irradiated by a precleaning lamp 25 to reduce the electrostatic attraction which holds the residual toner thereon. Then the residual toner is substantially removed from the drum surface by a cleaning device 27, including a housing 26, which is constructed in accordance with the invention. Finally, the drum is irradiated by a quenching lamp 28 to completely remove the residual charge from the drum, thus completing a copying cycle.

Figure 2:
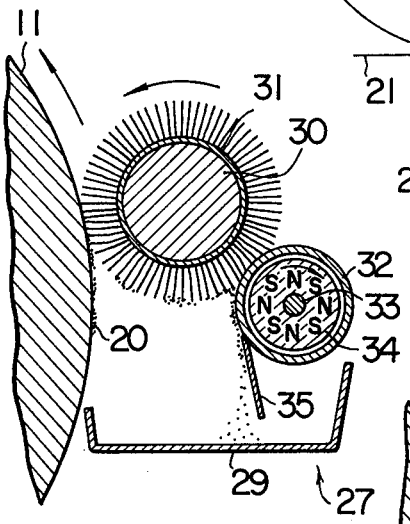
FIG. 2 is a schematic view of one embodiment of the cleaning device according to the invention.

The cleaning unit 27 is shown in detail in FIG. 2. As shown, it comprises a toner tray 29, a cylindrical fur brush 31 which is disposed above the tray 29 adjacent to the drum surface and mounted on a shaft 30 for rotation in a direction indicated by an arrow, a non-magnetic sleeve 32 which is fixedly located adjacent the brush 31 at a position to the right of and below it, a magnet 34 which is contained within the sleeve 32 and mounted on a shaft 33 for rotation in a direction indicated by an arrow, the magnet having a plurality of magnetic poles, and a separator 35 which is fixedly located close to the sleeve 32 at a position to the left of and below it. The purpose of the brush 31 is to wipe off any residual magnetic toner from the drum surface. Since the residual toner is not charged, it is unnecessary for the brush to apply an electric attraction, so that any cylindrical brush other than a fur brush which is capable of wiping off a magnetic toner, such as those formed of synthetic fibres or fabrics, may be used.

In operation, the toner 20 attaching to the drum surface is removed by the fur brush 31 which rotates in the direction of the arrow as it is rubbed against the drum 11, and is carried away therewith. The surface of the fur brush to which the toner 20 attaches moves into contact with the surface of the sleeve 32, whereupon it is magnetically attracted onto the sleeve by the action of the magnet 34 which is located therein and which rotates in the direction of the arrow. The attracted toner 20 moves on the sleeve 32 in the opposite direction from the direction of rotation of the magnet 34, and is scraped off by the separator 35 at a given position so as to fall down onto the tray 29 for accumulation thereon.

Figure 3:
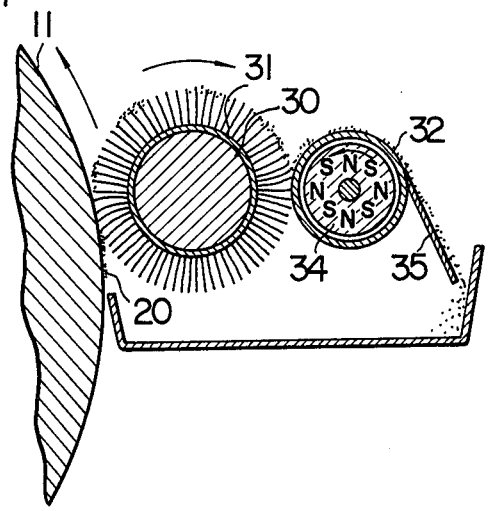
FIG. 3 is a schematic view of another embodiment of the cleaning device according to the invention.

In this embodiment, the brush 31 is rotated in the same direction as the drum 11. However, as illustrated in FIG. 3, it may be driven in the opposite direction from the direction of rotation of the drum and at a speed which is either greater or less than the rotational speed of the drum. Since the magnetic toner attracted onto the sleeve 32 moves in the opposite direction from the direction of rotation of the magnet, the magnet 34 is rotated in the opposite direction from that in the embodiment shown in FIG. 2, so that the separator 35 is located to the right of and above the sleeve 32.

In the two embodiments described above, the non-magnetic sleeve remains stationary while the magnet is driven for rotation. However, an inverse arrangement may be employed in which the magnet remains stationary while the sleeve is rotated. In this instance, the magnetic toner which is attracted onto the sleeve is conveyed as the latter rotates. Consequently, the separator is located in a direction opposite to the direction of rotation of the sleeve. For example, when the sleeve 32 is rotated in the same direction as the brush 31 in the arrangement of FIG. 2, the separator 35 may be located at the position shown. Alternatively, the magnet and the sleeve may be both rotated in opposite directions.

In an experiment conducted by the inventors, a photosensitive drum having an outer diameter of 120mm has been rotated at a peripheral speed of 80mm/sec. The brush used rabbit hairs, which are 10mm long, and had an overall outer diameter of 30mm, and was driven at a peripheral speed of 8mm/sec. The sleeve 32 had an outer diameter of 30mm, and an 8-pole magnet weighing 1000g was rotated at 300 rpm within it, corresponding to a peripheral speed of about 500mm/sec, to produce a good cleaning effect.

What is claimed is:

1. A method of cleaning toner from the surface of a photosensitive member in an electrophotographic copying machine of the dry, transfer type in which a magnetic toner is used as a developer, comprising the steps of: providing a rotatable cylindrical brush adjacent the surface of said photosensitive member to remove magnetic toner attached to the surface of the photosensitive member and transfer it to said brush by a mechanical rubbing action; transferring magnetic toner which attaches to the cylindrical brush onto a non-magnetic sleeve located adjacent the cylindrical brush and internally housing a magnet; providing relative rotation between the magnet and the sleeve; and scraping off any magnetic toner which attaches to the sleeve by a separator which is located adjacent the surface of the sleeve.

2. A method as in claim 1 further comprising the step of collecting the magnetic toner scraped off the sleeve by the scraper in a tray disposed beneath both.

3. An apparatus for cleaning toner from the surface of a photosensitive member in an electrophotographic copying machine of the dry, transfer type in which a magnetic toner is used as a developer, comprising:

a rotatable cylindrical brush means disposed adjacent the surface of the photosensitive member for non-electrically picking up toner therefrom by a mechanical wiping action;

a non-magnetic sleeve means disposed adjacent the cylindrical brush for picking up toner therefrom;

magnetic means disposed within said sleeve means for attracting magnetic toner to the surface of said sleeve means, said magnetic means and said sleeve means being rotatable relative to each other; and separator means located adjacent the surface of the sleeve means for removing toner therefrom.

4. An apparatus according to claim 3 in which the cylindrical brush comprises a fur brush.

5. An apparatus according to claim 3 in which the cylindrical brush comprises a synthetic fibre brush.

6. An apparatus according to claim 3 in which the non-magnetic sleeve rotates while the magnet remains stationary.

7. An apparatus according to claim 3 in which the magnet rotates while the non-magnetic sleeve remains stationary.

8. An apparatus according to claim 3 further comprising tray means disposed beneath said sleeve means and said separator means for receiving the toner removed from said sleeve means by said separator means.

* * * * *